US005396023A

United States Patent [19]

Pye

[11] Patent Number: 5,396,023

[45] Date of Patent: Mar. 7, 1995

[54] WHOLETONE MUSICAL SELECTION DEVICE

[76] Inventor: T. Wilfred Pye, 304 Fairmont Dr., Houma, La. 70360

[21] Appl. No.: 58,290

[22] Filed: May 4, 1993

[51] Int. Cl.[6] ..... G10C 3/12

[52] U.S. Cl. ..... 84/433; 84/704

[58] Field of Search ..... 84/423 R, 423 A, 428, 84/429, 451, 704, 718, 719, 433, 437

[56] References Cited

U.S. PATENT DOCUMENTS 24,021 5/1859 Gould ..... 84/428
360,255 3/1887 Janko ..... 84/428
1,038,549 9/1912 Fischer .
5,129,303 7/1992 Coles ..... 84/423 A X

*Primary Examiner*—Michael L. Gellner
*Assistant Examiner*—Patrick J. Stanzione

[57] ABSTRACT

Novel shapes and interrelationships of interreactive domains for wholetone musical selection devices such as keyboards or other user interface medium are described. Chromatic glissandos are allowed on these devices. Operator choice for ascending or descending one finger slurs using any one of the twelve per octave fingerkeys as slur instigator or slur receptor is optimized. Novel one digit multiple pitch slurs numbering three or four pitches are acheived.

20 Claims, 7 Drawing Sheets 16
33
15
11
10
12
24
31
13
14
17

18
12

35
19

20
36

25
29
26
27

53
34
37
38

55
57
56
54

WHOLETONE MUSICAL SELECTION DEVICE

This application relates to the field of music, and more specifically to the shapes and interrelationships of interreactive domains for musical selection devices such as keyboards, and with cognitive octave landmark systems used to distinguish them.

DEFINITIONS AND BACKGROUND

A domain is all or a portion of the tactile surface of a physical object or discrete entity having at the minimum two dimensional boundaries and dedicated to selection by humans to effect command. In this case, to command the production of musical tones. The two dimensional boundaries of the domains may lie in a curved two dimensional space following the surface shape of the underlying object or entity. Examples would be a typical computer screen or along the user contacted tops of traditional three dimensional fingerkeys. Domains in conjunction with a plurality of other similar domains create zones of common influence termed either contiguous domains or broken domains.

Contiguous domains are a directional stream (in this case a horizontal stream) of like domains aligned in the same general plane allowing by sequential selection a sounding of a recognized grouping of tones. In the preferred embodiment of this invention, this recognized grouping is a series of wholetones, which are commonly expressed in the art as a collection of tones that are 200 cents apart.

Broken domains are also a directional stream (also in this case a horizontal stream) of like domains aligned in the same general plane, but only offering by individual (not sequential) selection a recognized grouping of tones. The sequential selection is denied by other structure passing through and impeding the general plane holding the broken domains. As a further understanding of this, a study of the common keyboard (FIG. 6A) is warranted, as it clearly illustrates both contiguous and broken domains.

The front ends of the seven per octave white keys are contiguous domains. In FIG. 6A the frontal domain of the B fingerkey is designated as 41. Posterior to these contiguous domains is a region collectively termed the intrusion zone. The back domain 40 of the B fingerkey forms with the other back domains a broken domain zone. Rising (intruding) between most of them are the five shortened black fingerkeys such as Bb 39. The latter are uniformly elevated to have their upper surfaces also form contiguous domains. This is true because in the plane containing these elevated domains, there is no impeding of direct lateral movement by the musician.

Because they are freely accessed in a common plane, both the back keys and the anterior portions of the white front keys form contiguous domains and allow glissandos. In and amongst themselves, the posterior portions of the white keys do not allow glissandos. A glissando is an operator maneuver whereby a digit is run rapidly over a minimum of three laterally aligned domains to create a desirable musical effect.

From the perspective of the musician, the rear keys are collectively accessible to the fingers for individual selection or for pentatonic glissandos mainly in the key signatures of E flat minor and G flat major. The anterior portions of the front keys are collectively accessible for individual selection or for diatonic glissandos mainly in the key signatures of C major and A minor. And the posterior portions of the front keys are only accessible as broken domains providing individual selection only.

The most obvious characteristic of this common layout is the fact it is by definition an irregular system. The grouping of tones triggered by either form of glissando does not increment by uniform intervals and hence limits their usefulness in almost all the key signatures except a select few. If employed in the nonselect majority of key signatures, these glissandos tend to sound from slightly disturbing to highly disturbing.

Some other drawbacks to this irregularity are that chords and scales employed to produce correct performances are fingered differently from key signature to key signature, and scaling speed suffers in instances where a digit must leap over a black key to link a broken domain pathway.

Finally, the common keyboard does not have the power to use any one of the 12 tonal fingerkeys as the beginning or end of a musical slur executed with one digit. A slur (or grace note) is the rapid sounding of two tones separated by a semitone. On the common keyboard, only the anterior domains of the D, G, and A fingerkeys have a black semitone positioned on both left and right corners. The C and F have a black key to the right, only allowing a descending slur. The B and E have a black key to the left, only allowing an ascending slur. It is impossible to do a one-finger slur to the five black keys themselves, because a finger cannot slam a white key, slide off, and simultaneously jet upwards fast enough to finish up on a black key's top with the correct effect. Jazz artists especially do copius amounts of one-finger slurs for musical expression. Keeping track of multiple slur feasibility arrangements is frustrating to most musicians of the common keyboard.

Although a wholetone arrangement of fingerkeys offers more slur opportunities than a common keyboard, the symmetrical layout causes operators to suffer orientation problems. The use of five landmarked keys of like countenance per octave has been employed. This scheme highlights the five accidentals of the major scale as does the common keyboard.

PRIOR ART

There are two prior art examples to be cited that best illustrate the concept of wholetone fingerkey arrangements. The oldest and pioneer patent U.S. Pat. No. 24,021 was issued to Gould and Marsh in 1859. They used all white keys. The widely known and remembered Paul Janko was granted U.S. Pat. No. 360,255 in 1887. The latter worked diligently to improve and promote the wholetone keyboard. His embodiments used the five traditional black keys.

In their figure two embodiment, Gould and Marsh have the contiguous domains appear per octave as six surfaces configured to sound wholetone intervals. In the manner of the common keyboard, the elevated rear digitals also provide contiguous domains placed above a bed of broken domains created by rear extensions of the front keys. These upper keys also play whole tones uniformly.

However, this arrangement was still not ideal, as modulations to the rear keys were difficult. To overcome this, in their favored arrangement, Gould and Marsh show in their figure one embodiment another zone of contiguous domains rising behind the rear keys. By converting the rear keys to wide keys to create uniform fingering, the broken domains are gone. The net effect is three tiers of contiguous domains. The hindmost domains play unison notes to the first zone of contiguous domains. With this design, modulations to the rear keys finger the same as those to the front keys.

The idea behind the latter embodiment was to create a regular layout to allow similar fingerings for all chording and scaling. The goal was achieved. Despite their enthusiasm, this arrangement did not prosper either. All glissandos in all key signatures were slightly disharmonic because of the juxtaposing of sequential accidental pitches. This was the unfortunate side effect of a series of wholetones. And the fingering was what today would be called 'typewriter' style, and discomfort from users from the constant use of the fingertips rather than the balls of the digits probably brought Gould and Marsh no acclaim.

To overcome the fingertip problem, Janko added three additional tiers of unison notes that retarded the action, but which allowed a much more comfortable spreading of the digits. Players devised somewhat comfortable fingerings sometimes spanning four tiers. However, the visually complex design, slightly sour glissandos, and bad action in a day of common and simple looking pianos with sweeping glissandos (in the key of C) and wonderful action defeated the plucky Paul Janko and his many supporters. To this day the idea of the wholetone keyboard has languished.

GOALS AND OBJECTIVES

The intent of the instant invention is the goal of total one-digit slur flexibility for a wholetone arrangement of fingerkeys. Total flexibility means any fingerkey may sound either the first or last pitch of a slur.

Another goal is the providing of multiple note one-digit slurs beyond the common two pitch variety available on the common keyboard.

Another goal is the creation of speed enhanced fingering without undue stretching or excessive fingertip usage, more in keeping with the fingering provided by the common keyboard, but without the lateral impediments to broken domain scaling intrinsic to the common keyboard.

Another goal is that the key shapes must additionally allow more musically useful glissandos such as semitone glissandos that do not have sequential accidental tones.

LIST OF ILLUSTRATIONS

FIG. 1A shows a direct view of the domains of front and back keys with level intrusion in a typical user interface electronically configured within touch responsive medium, in this case a CRT screen. The screen 21 is electronically connected by cable 22 to descriminative electronic means 23 configured to distinguish user selection of the domains. The level intrusion zone is the horizontally aligned region including domains 10, 11, and 18 that allows semitone glissandos along the CRT surface.

FIG. 1B shows a direct view of the domains of front and rear keys having similar domain organization to the FIG. 1A embodiment. However, the front keys have their centers lengthened into a transitional region 47 between anterior portion 46 and posterior portion 48. The rear fingerkeys have an analogous transitional region 52 behind and in close proximity to the bar segment 51 of the level intrusion zone.

Figures 3A, 3B, 3C:
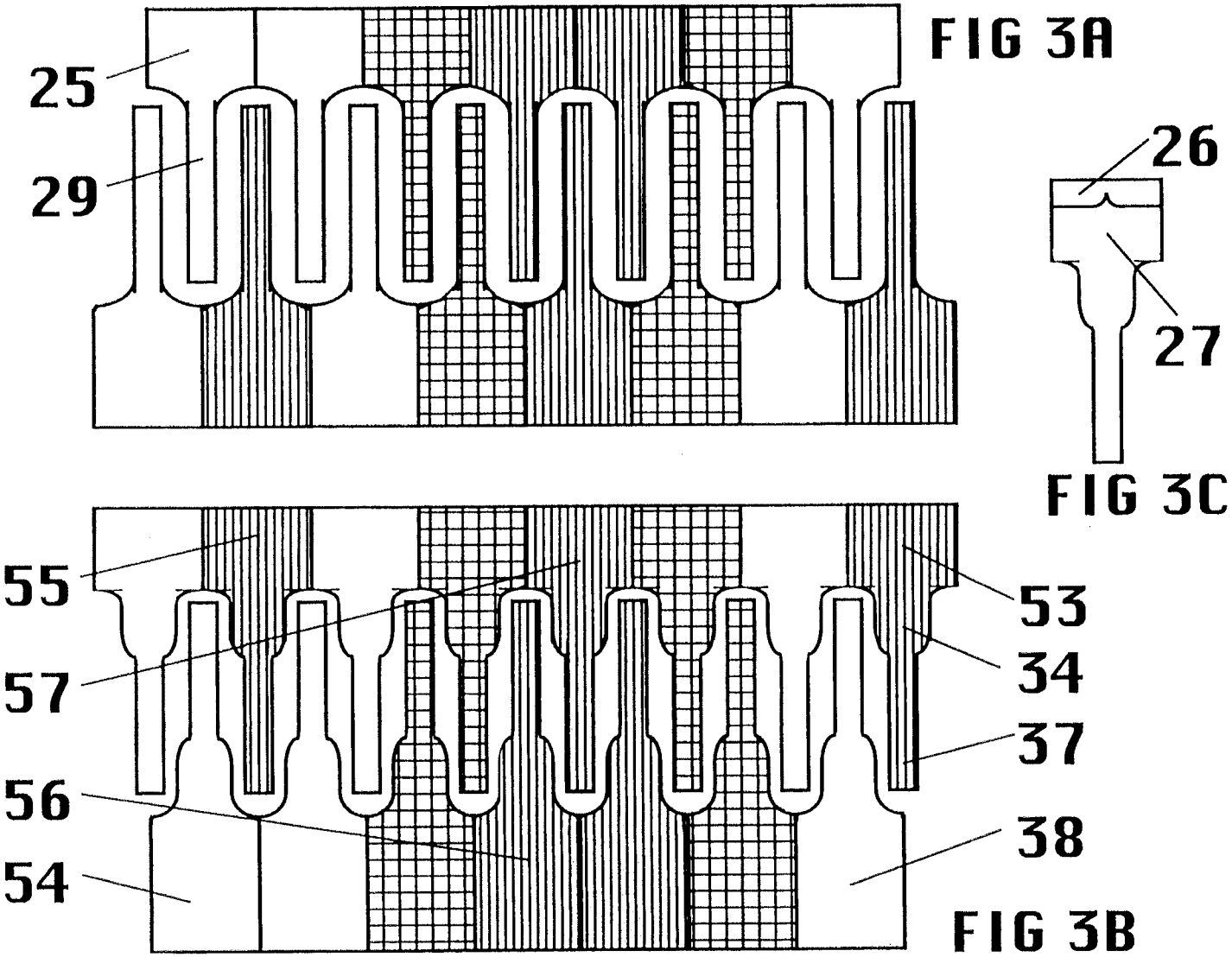
FIG. 3A shows a direct view of front and rear domain arrangements suitable as an improved variation of the FIG. 1A embodiment. The rear key 29 is extended and broadened 25 to form a second contiguous domain zone.

FIG. 3B shows a direct view of front and rear domain arrangements having similar organization to the FIG. 3A embodiment. However, as was seen for FIG. 1B, intermediate regions are present. A second domain 53 appears posterior to the depicted tapered portion of the rear key.

FIG. 3C shows a direct view of a rear fingerkey similar to the rear key of FIG. 3B but having the farthest portion 26 of the posterior domain maintaining a different (elevated) plane than the anterior portion 27.

Figures 4A, 4B, 4C:
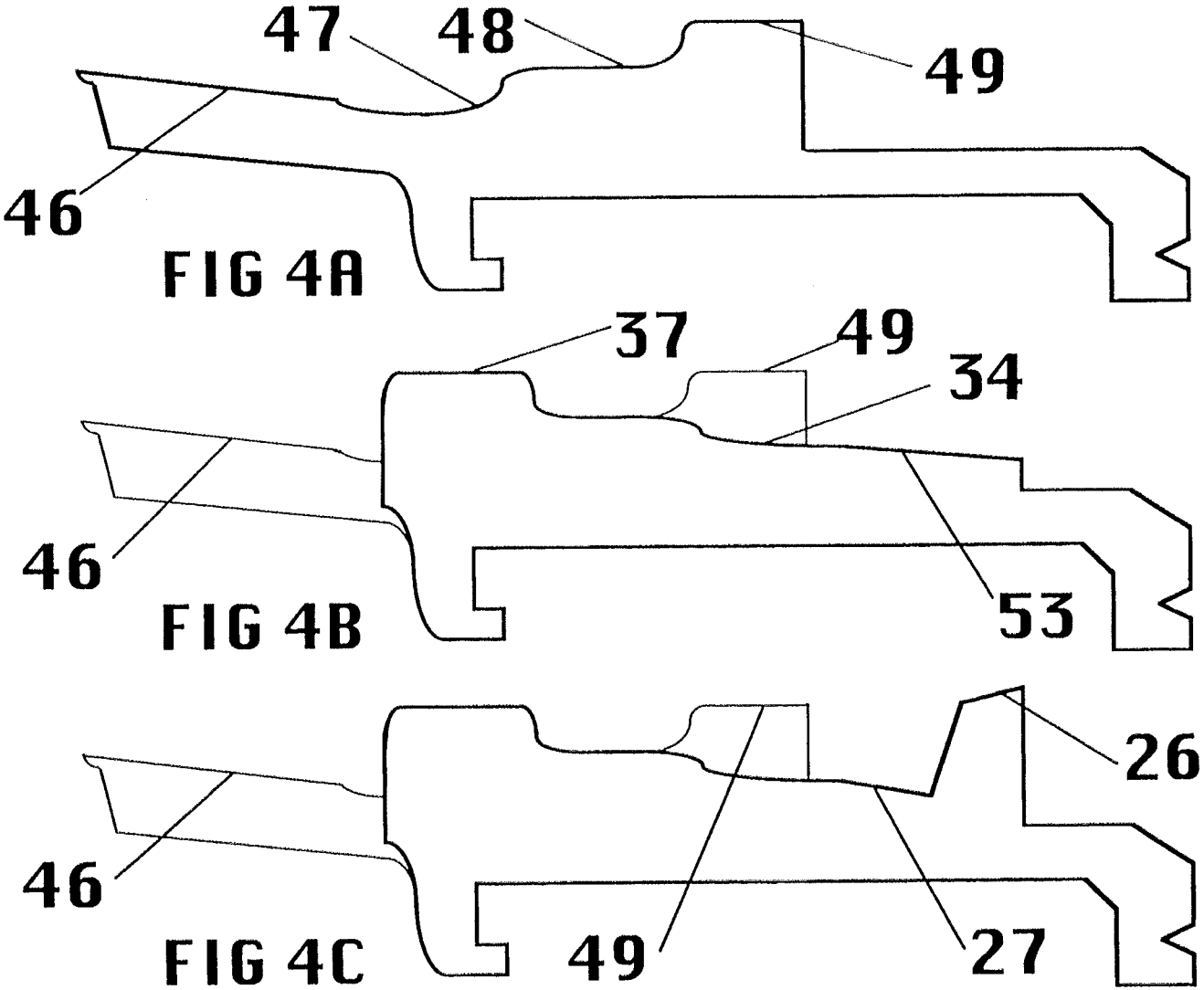

FIG. 4A shows a side view of the preferred motile embodiment front key.

FIG. 4B shows a side view of a motile embodiment rear key with the domains corresponding to the rear key domains depicted in FIG. 3B.

FIG. 4C shows a side view of the preferred motile embodiment rear key with the domains corresponding to the rear key domains depicted in FIG. 3C.

Figure 5:
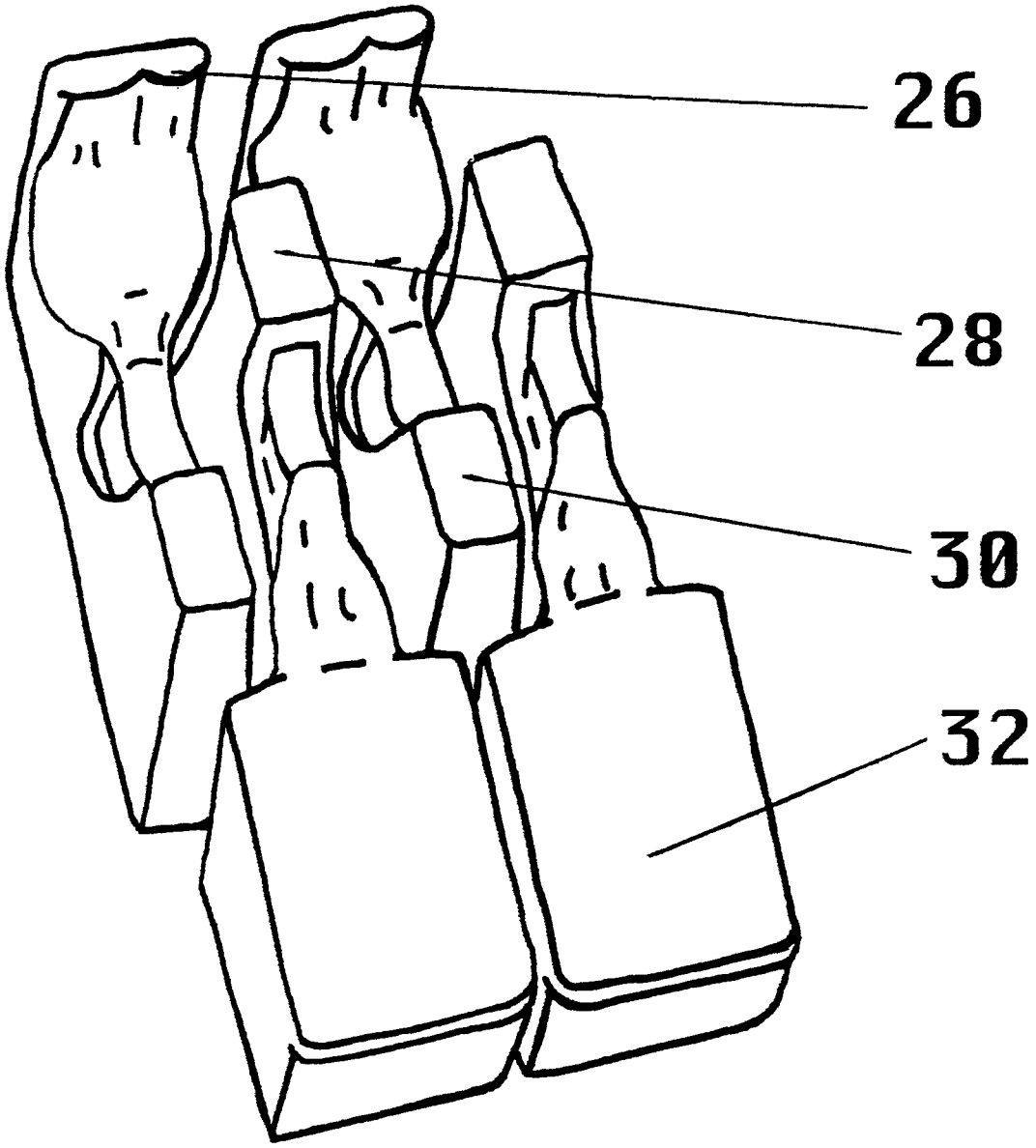

FIG. 5 shows a perspective view of two front keys of the FIGS. 3B and 4A embodiment together with two of the variation rear key depicted in FIGS. 3C and 4C. Domain 26 has a central portion with less surface extending rearwards than the remaining side portions. An ascending four pitch slur can be sounded by sweeping a digit forward and to the right from domain 26 to domain 28 to domain 30 to domain 32. A descending four pitch slur would be done in similar fashion by sweeping the digit forward and left.

Figure 6A:
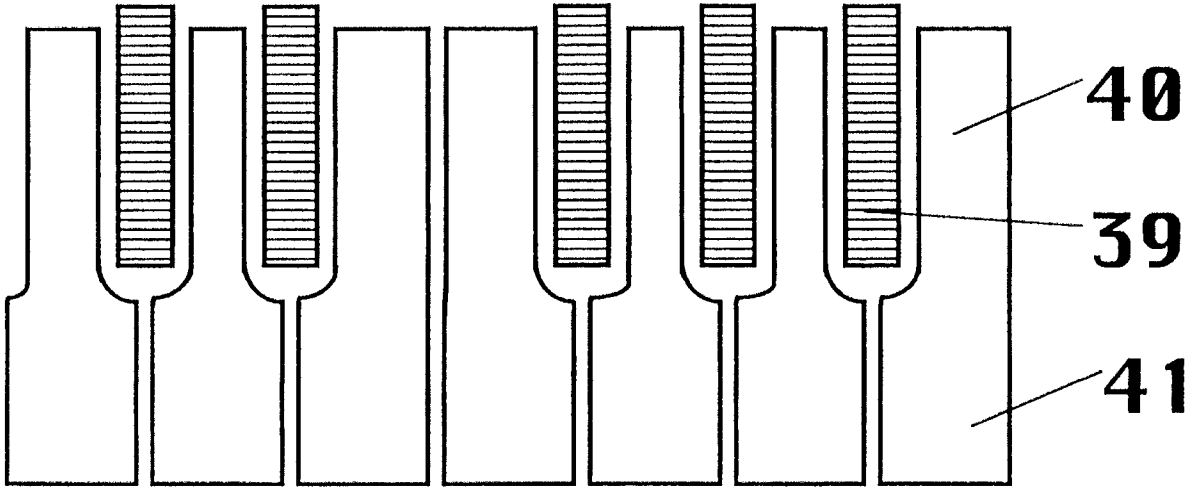
FIG 6A Prior Art

FIG. 6A shows a top view of the prior art common keyboard. Anterior domain 41 together with posterior domain 40 are the tactile interface for a front key. Domain 39 is the tactile interface for a rear key.

Figure 6B:
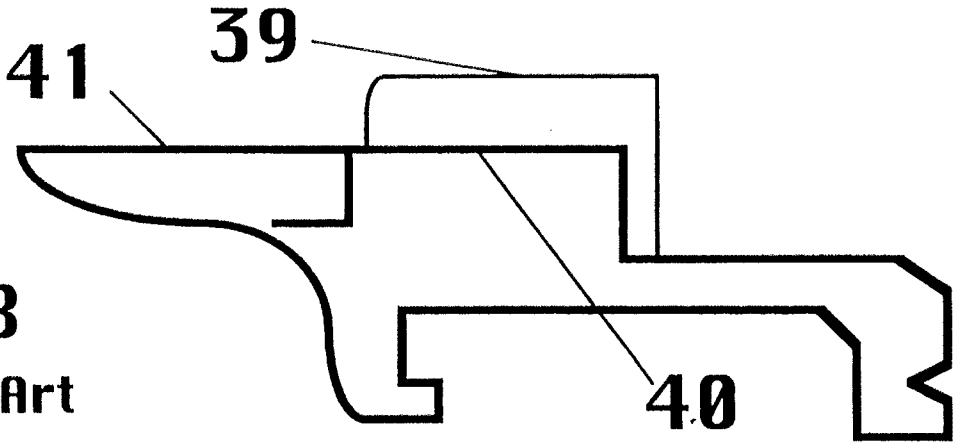
FIG 6B Prior Art

FIG. 6B shows a side view of a front key next to a partially obscured rear key of the prior art common keyboard.

Figure 7A:
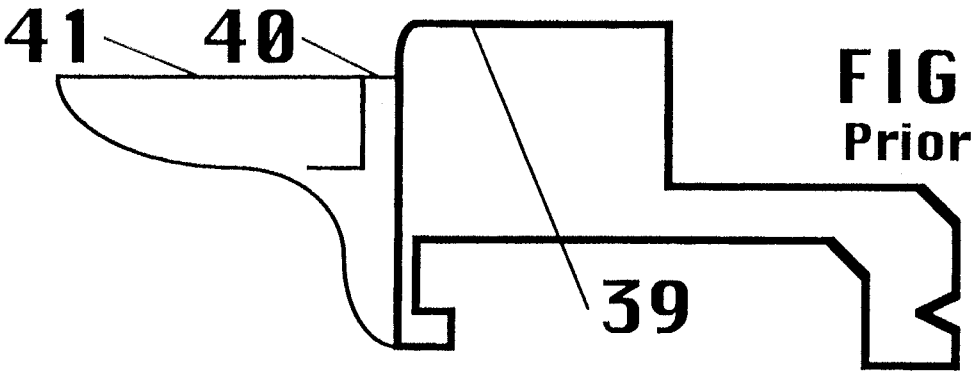
FIG 7A Prior Art

FIG. 7A shows a side view of a rear key next to a partially obscured front key of the prior art common keyboard.

Figure 7B:
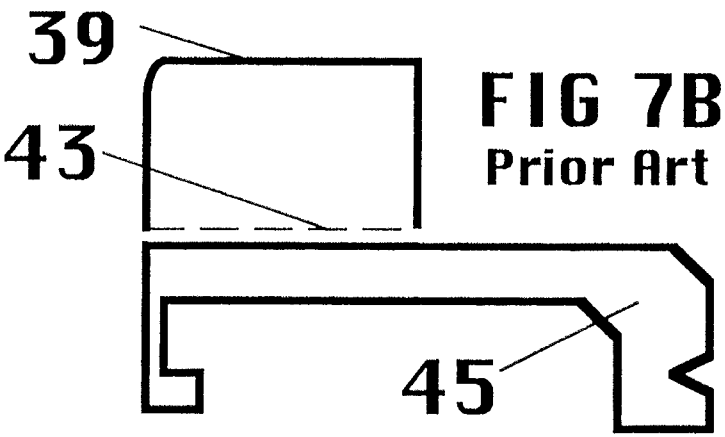
FIG 7B Prior Art

FIG. 7B shows a side view of a rear key of the prior art common keyboard with the bar section cut away from the shaft in preparation for a retrofit to attach structure (not shown) of the instant invention.

Figure 7C:
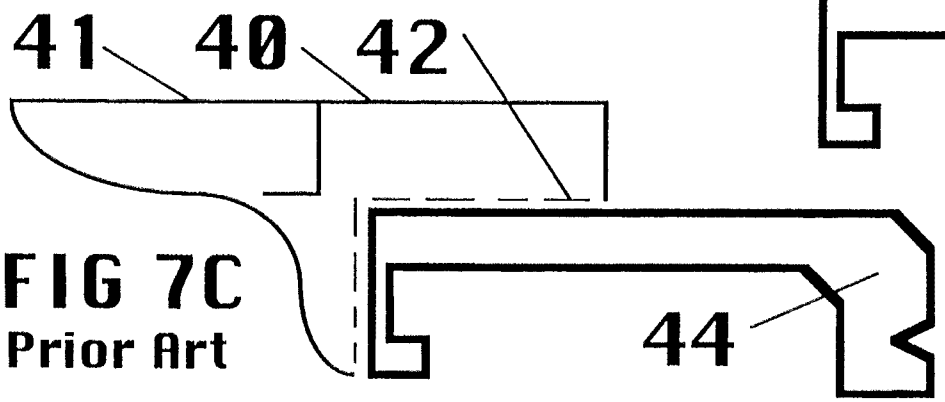
FIG 7C Prior Art

FIG. 7C shows a side view of a front key of the prior art common keyboard with the tactile section cut away from the shaft in preparation for a retrofit to attach structure (not shown) of the instant invention.

DISCUSSION

Figure 1A:
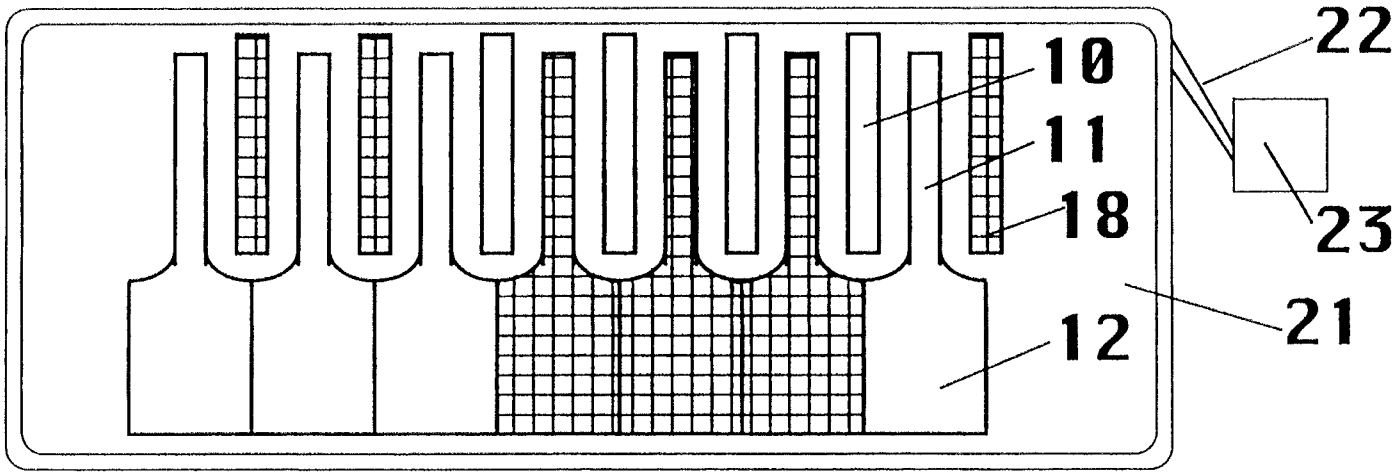

In the basic configuration of FIG. 1A, the anterior portion 12 of front key C tapers back to a narrower domain 11 in the posterior region placed between rear keys 10 and 18. Because rear key 10 appears adjacent and left of the C front key, it controls a B pitch. Adjacent to it and to the left would be a Bb front key, and so forth down the chromatic scale. For a typical landmark scheme, the five major scale accidentals have a visual landmark crosshatched to depict the color black. However, the octaves could as well been depicted with the landmark schemes of FIGS. 3A or 3B.

The instant invention uses the novel process of level intrusion to allow chromatic glissandos. The level intrusion zone is a zone containing two sets of broken domains sharing a common plane. A characteristic of any true intrusion zone whether level or unlevel is that the pitches controlled by one of the two broken domains within the zone itself can not be sounded by the musician at any domains positioned anterior to the zone itself. If this characteristic is violated the stated arrangement would simply be two independent keyboard interfaces aligned one behind the other.

The level intrusion zone thus allows for the sequential generation of a more complex grouping (chromatic) of tones than is collectively expressed (wholetone) by one or the other of the broken domains themselves. The glissandos are capable of incorporating all 12 pitches per octave for the scale employed whether equal temperament or microtonal. In common major or minor scale applications, no two accidentals are ever sequential and the glissandos are thus equally useful in all 12 key signatures.

Figures 2A, 2B, 2C, 2D:
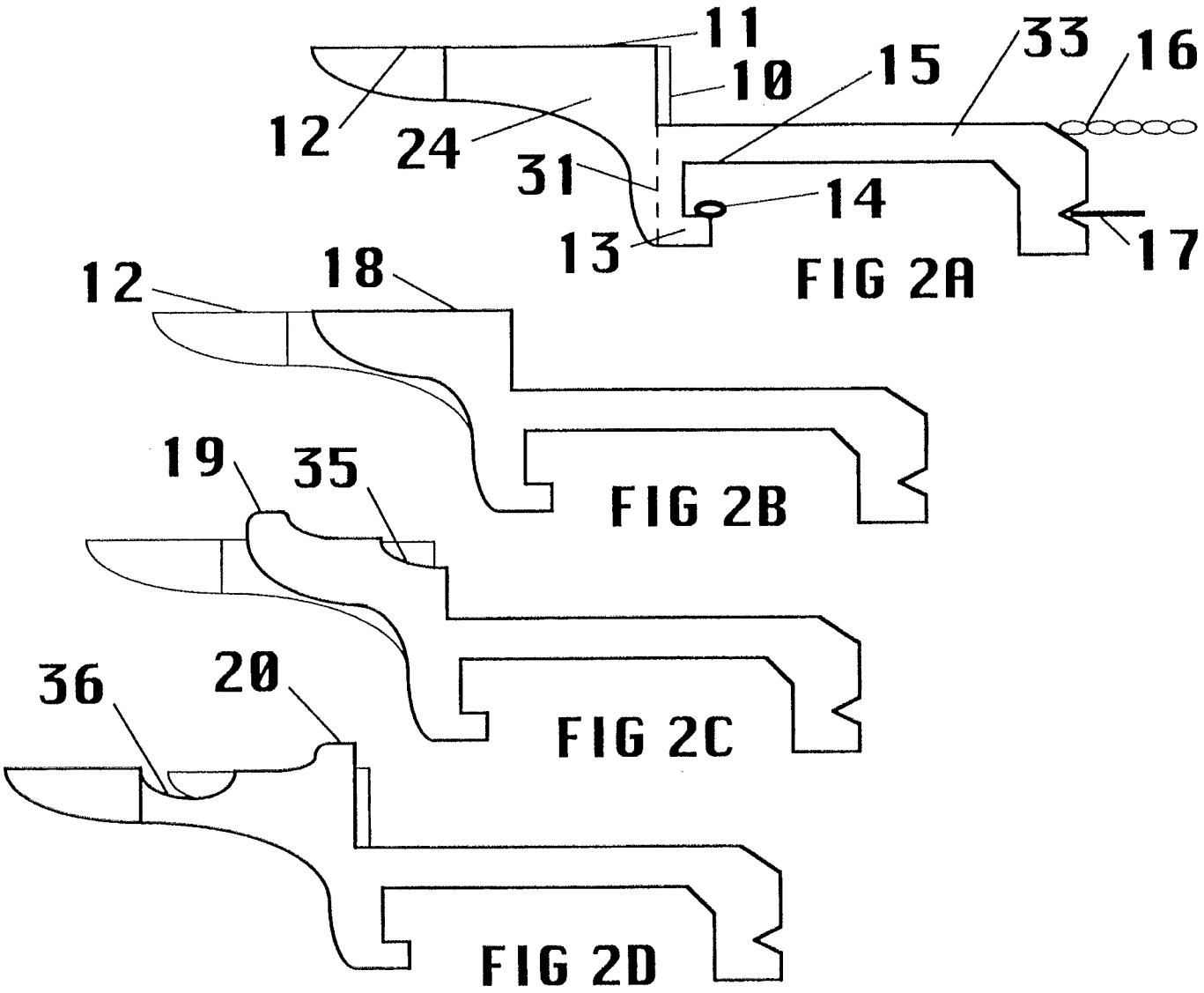
FIG. 2A shows a profile of a front key next to an almost totally obscured rear key of a motile embodiment with the domains analogous to the FIG. 1A embodiment, together with additional shaft structure for a typical spring powered return action. All fingerkey profiles shown are at rest position.
FIG. 2B shows a profile of a rear key 18 of a motile embodiment with the domains analogous to the FIG. 1A embodiment, together with additional shaft structure for a typical spring powered return action. The anterior domain 12 of the adjacent front key is visible behind the closer rear key.
FIG. 2C shows a profile of an improved rear key along the designs of the FIG. 2B embodiment with the anterior most tip 19 of the domain lifted above the plane of the level intrusion zone. The posterior portion 35 of the domain has been lowered below the plane of the level intrusion zone.
FIG. 2D shows a profile of an improved front key along the designs of the FIG. 2A embodiment with the posterior tip 20 of the posterior domain lifted above the plane of the level intrusion zone. The anterior portion 36 of the posterior domain is lowered below the plane of the level intrusion zone.

FIG. 2A depicts a motile front fingerkey 12 in profile with rear key 10 behind it. The underlying structure 24 beneath anterior domain 12 and posterior domain 11 is installed on shaft 33 at separation line 31. These two domains and structure 24 could have been installed on shaft 33 at the time of manufacture as one integral whole by injection molding as is the usual process. Shaft 33 uses a typical electronic keyboard mechanism. Upward movement generated by spring 16 creating tension over hinge 17 is halted by rib 13 meeting fixed stop 14. Downward pressure (not shown) on a domain causes the bottom 15 of shaft 33 to hit stop 14 and go no further. Shaft 33 and its associated parts is considered prior art and serves no part of the present invention unless manufactured as an integral whole or as a designed receptor for domains of the instant invention. Keyboards are anticipated by the inventor with the domains of the common fingerkeys removed and retrofitted to employ the domains of the instant invention.

FIG. 7B shows a prior art rear key with the bar section providing the upper domain 39 cut away or removed along line 43 from shaft 45. FIG. 7C shows a prior art front key with the support section providing the domains 40 and 41 cut away or removed along line 42 from shaft 44. Shaft 33 of FIG. 2A can be considered to be either of shaft 44 or 45 if retrofitting is involved. Other pivoted mechanical shaft structure as is used by pianos is also feasible instead of the spring type action used herein for illustration.

With respect to chording, a flat motile embodiment (such as FIGS. 2A and 2B disclose) would be lacking in clearance depth when the player must modulate to the rear keys as tonics. Structure to decrease this problem somewhat can be added as elevated regions on the free ends of the domains in the level intrusion zone, or adjacent fingerkey structure can be lowered, or both methods can be combined. This will also enhance slur capabilities and allow fast lateral movement of the digits for broken domain scaling.

Figure 1B:
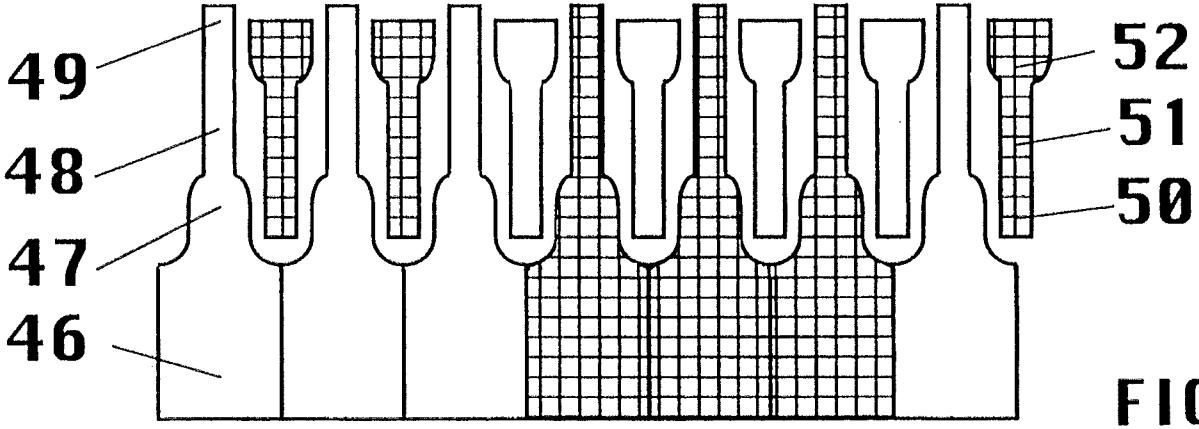

FIG. 2C shows a rear key in profile with the anterior tip 19 of the domain lifted above the plane of the level intrusion zone and with the posterior end 35 of the domain lowered below the plane of the zone. FIG. 2D shows a front key in profile with the posterior tip 20 of the rear domain lifted above the plane of the level intrusion zone and the anterior end 36 of the rear domain lowered below the plane of the zone. When utilized in motile embodiments, the wider regions 47 and 52 of FIG. 1B are analogous to recessed regions 36 and 35 of FIGS. 2C and 2D respectively.

Further lengthening and widening a new domain 25 from the posterior portion of the rear key 29 beyond the level intrusion zone creates the improved embodiment of FIG. 3A. With this structure, the level intrusion zone is more properly termed a reverse level intrusion zone, as both of the contiguous domain zones intrude a narrower segment into the common zone between them. The presence of the contiguous domains along the rear of the playing field allows wholetone glissandos and also allows (relative to a rear key as tonic) frequently used intervals like the major 3rd to be struck cleanly when rapid chord changing is required. Discounting the different feel of the underlying domain shapes, fingerings based on the rear six keys as tonics are similar to those based on the front six keys as tonics.

FIG. 4A shows a side view of the preferred motile embodiment front key. Region 47 is excavated in a gently curving fashion below the level of anterior domain 46, and sweeps up to connect with posterior domain 48, which is in a plane lower than elevated tip region 49. A digit depressing the anterior tip of a rear key does not descend far enough to touch region 47. If a slur is desired the digit can smoothly slide off the tip down to the left onto either region 47 or domain 46 to create a descending slur. Similarly a slide maneuver to the right generates an ascending slur.

This also explains the purpose of region 34 as seen in FIG. 4B. This allows a digit depressing posterior tip 49 of an adjacent front key to not normally touch region 34. And if a slur is desired the digit can smoothly slide off tip 49 down to the left on to region 52 to create a descending slur. In a similar fashion a slide to the right generates an ascending slur.

When in at the rest position, anterior domain 46 is tilted by rearward slanting such that the anterior most section is at a higher altitude than the posterior part. When depressed by the operator (not shown), domain 46 assumes a more level condition. This tilt allows operators to engage domain 46 at a position relative to the back keys that decreases the physical distance when movements from one to the other are required. This shortened distance increases the modulation speed and is recommended.

Also worth lowering by forward slanting (not shown) is the at rest height of the anterior ends of the back key domain 37. With the common keyboard, the back keys ride about 11 to 12 millimeters above the front keys. The excavated region 47 of the front keys immediately alongside these anterior ends allows clearance when the anterior ends of the back keys are depressed (not shown). In an at rest configuration as is shown in FIG. 4B, a level line (not shown) running from the anteriormost tip of domain 46 would in the preferred embodiment be approximately 7 or 8 millimeters below domain 37. This low slung arrangement is recommended as a speed enhancing feature and to generate less impediment to activities employing the posterior structures. Further lowering of the anterior tips of the rear keys is possible, but would probably prove to be excessive.

In FIG. 4B the posterior domain 53 of a rear key is seen in profile to hold a plane position lower than the plane of the gently curving and contiguous excavated region 34. Domain 53 slightly slopes off the perpendicular in the posterior direction. This slope in actual practice complements the downward tilt of the inner digits when for example the thumb and little finger are placed on anterior positions of some of these same rear keys.

In FIG. 4C the addition of an elevated region 26 at the posterior most end of the rear domain 27 gives a player the ability to strike a slur from region 26 to tip 49 of an adjacent front key. A direct view of this is shown in FIG. 3C, and a perspective view in FIG. 5. FIG. 5 shows that a four frequency slur is possible by sweeping a digit from region 26 to tip 28 to tip 30 to domain 32. From start to finish, this big slur spans a minor third interval.

The overall field of depth for the domains of the embodiment of FIGS. 3B, 4C and 5 can be constructed to have a value of roughly 14 or 15 centimeters to allow the replacement of the common keyboard fingerkeys. The distance between octave fingerkeys would be structured to be the same as the octave distance of the common keyboard in a replacement situation. Of course, with the instant keyboard constructed free of retrofitting constraints, both the octave and/or the depth distance would be free to be designed at greater or less values than those of the common keyboard. A reference pitch such as C can be placed either on one of the front keys as is seen in FIGS. 1A, 2B or 3B, or C could be situated on one of the rear keys 29 as is seen in FIG. 3A. (This scheme is a mirror image of the FIG. 3B layout.)

The various fingerkeys themselves can be tinted. Other landmark systems such as texture can be employed to give certain fingerkeys tactile embellishments for identification other than by sight. However the use of the usual five major scale accidental keys per octave is not fully optimized for operators because too many fingers must keep touching too many keys.

What is desired is a landmarked arrangement allowing an unsighted player to touch any two fingerkeys of a known small interval separation, and have the identities of both fingerkeys revealed. As a limiting factor, no more than three different textures and/or three different tints should be employed. With this in mind, the preferred landmark system is depicted in FIG. 3B. It requires the 12 fingerkeys to be landmarked in three groups of four keys. The C# rear key 55 is marked the same as its own rear key octave counterpart 53. It is also landmarked the same as the front F# key 56 and rear G key 57 together with the next sequential front G# key. It is seen the B, C, D, and D# are within a group, and E, F, A, and A# are the third group. For instance one four member group together with their octave counterparts could all be tinted grey and marked tactilely with raised veins or thin grooves. Another group together with their octave counterparts could be tinted black and marked tactilely with tiny bumps. The remaining four keys per octave could be uniformly tinted white and unembellished with tactile variance, and serve as the standard reference keys.

All 12 possible flatted second intervals have a different orientation relationship. For instance, White C key 54 and black C# key 55 hold the unique relationship front-white to rear-black. (Or in the cited texture scheme front-smooth to rear-bumps.) Similarly all major second, third, fourth, and fifth intervals have unique two key orientations. The operators only needs to 'see' the distinctive octave pattern in their minds to instantly locate the placement of the surrounding keys they are not touching.

CONCLUSION

The instant invention is primarily concerned with the user interreactive surfaces and subdivisions of two collections of domains and the way they relate to each other. When fitted or connected to tone sounding apparatus or data memory banks, the two collection of domains alternate in a lateral stream to provide a means for a player to ultimately trigger musical tones. The basic and preferred organization and nature of these two collections of domains has been described and depicted. Domains and enhancements were added in the posterior direction building from the domains of the basic invention. This process could have been continued further than illustrated. Conversely, they could have been added in the anterior direction, such as a narrower domain anterior to domain 12 of FIG. 1A, and so forth.

The method of user interreaction with the domains is variable. In a common piano, the domains are the tactile upper areas of structure fused to motile shafts rocking over pivots and maintained by counterweight. The various springs of electronic keyboards drive their shaft's return action.

Rather than utilizing these or other mechanical fixtures to effect command, the described domains may lie organized within other medium, such as a cathode ray tube or other electronic display configured to discriminate regions when touched or actively selected by operators. Thus, computer programs containing the programmed data to organize two dimensional user interactive surfaces with the described distribution of surface area would fall within the intent and confines of this paper. Because of this, the invention can be simultaneously categorized as what has been recently defined in various courts of law as a graphical user interface (GUI). Especially see Apple vs. Microsoft U.S. 1989.

Dedicated thin and generally flat playing fields having nonmotile subdivisions with shapes configured and aligned as described herein would also apply. These shapes may be electrically conductive film or interactive overlays such as piezo transducers or the like, all capable of signaling to tone generating means or data recording means the desires of an operator interfacing with the shapes with the intent of creating musical works.

Although this invention is one and the same thing, it may be perceived or interpreted in various ways. For example, to some it may be seen as a collection of domains, each holding a certain unique spatial alignment in a curved two dimensional space, and each domain capable of interaction with musicians. To others it may be recognized as one or more unique fingerkey structure attachable to motile means for the triggering of electronic or mechanical signals for inducing the production of electronic or acoustical musical tones. To others it may be described as a unitary musical keyboard expressing level intrusion or the variation of reverse intrusion. Others may perceive this invention as a novel octave landmark system for a wholetone fingerkey arrangement used to convey fingerkey identity information to the minds of operators by the unique orientations of a plurality of key surfaces.

This invention should not be confined to the embodiments described, as many modifications are possible to one skilled in the art. This paper is intended to cover any variations, uses, or adaptations of the invention following the general principles as described and including such departures that come within common practice for this art and fall within the bounds of the claims appended herein.

I claim:

1. A key entity for the motile shaft of a musical keyboard, said key entity with an upper surface of a size and substance suitable for tactile engagement with the fingers of an operator, said key entity longitudinally greater in length than in width, with a particular end of said key entity having a single domain of greater width than the width of a second domain of a second end of said key entity, said width of said second domain less than one half of said greater width of said first domain, said second end centrally located relative to said particular end, such that a longitudinal straight line along the approximate middle of said particular end passes through the approximate longitudinal middle of said second end, said particular end and said second end of said key entity interconnected, such that a fingertip of one hand may move back and forth from either of said ends without losing physical contact with said key entity, with a first two-dimensional plane established by the majority of said single domain of said particular end occupying a different and distinct plane than a second two-dimensional plane established by the majority of said second domain of said second end of said key entity.

2. The key entity of claim 1, with said first two-dimensional plane of said single domain positioned lower in space than said second two-dimensional plane of said second domain.

3. The key entity of claim 1, with a third domain, said single domain of said particular end between said second domain of said second end and said third domain, with said first two-dimensional plane of said particular end occupying a different and distinct plane than a third two-dimensional plane established by the majority of said third domain of said second end of said key entity, with said first two-dimensional plane of said single domain positioned lower in space than said third two-dimensional plane of said third domain.

4. The key entity of claim 1, with a third domain, said third domain positioned lengthwise between said single domain of said particular end and said second domain of said second end, with a third two-dimensional plane established by the majority of said third domain at a different spatial location relative to both two-dimensional planes of said single domain and said second domain.

5. The key entity of claim 4, said first two-dimensional plane of said single domain positioned lower in space than said second two-dimensional plane of said second domain.

6. The key entity of claim 4, with said third two-dimensional plane of said third domain positioned lower in space than said first two-dimensional plane of said single domain.

7. The key entity of claim 4, with said third two-dimensional plane of said third domain spatially positioned at an intermediate level located within the outer boundaries established by both said two-dimensional planes of said single domain and said second domain.

8. The key entity of claim 4, with said third domain of an intermediate width less than said width of said particular end and greater than said width of said second end of said keyed entity.

9. The key entity of claim 4, with said third domain of an intermediate width less than said width of said particular end and less than said width of said second end of said keyed entity.

10. The key entity of claim 4, with a fourth domain positioned lengthwise between said third domain and said single domain of said particular end, with a fourth two-dimensional plane established by the majority of said fourth domain at a different spatial location relative to both two-dimensional planes of said single domain and said third domain.

11. The key entity of claim 10, with said first two-dimensional plane of said single domain positioned lower in space than said second two-dimensional plane of said second domain.

12. The key entity of claim 10, with said third two-dimensional plane of said third domain spatially positioned at an intermediate level located within the outer boundaries established by both said two-dimensional planes of said single domain and said second domain.

13. The key entity of claim 10, with said fourth two-dimensional plane of said fourth domain positioned lower in space than said first two-dimensional plane of said single domain.

14. The key entity of claim 10, with said fourth domain of an intermediate width less than said width of said particular end and greater than said width of said second end of said keyed entity.

15. The key entity of claim 10, with said third domain of a width less than said width of said particular end and less than said width of said second end of said keyed entity.

16. The key entity of claim 10, with said single domain of said particular end of a generally flat and rectangular shape displaying a width greater than 14 millimeters, with said fourth domain longer than wide and of a shallowly downward curved and generally rectangular shape displaying a width greater than 8 millimeters, with said third domain longer than wide and of a generally flat and rectangular shape displaying a width greater than 4 millimeters, with said second domain longer than wide and of a generally flat and rectangular shape displaying a width greater than 6 millimeters, with the location of the midpoint of said single domain positioned lower in space than the midpoint of said second domain by a distance greater than 8 millimeters, with the location of the midpoint of said third domain positioned lower in space than said midpoint of said second domain by a distance greater than 3 millimeters, with the location of the midpoint of said fourth domain positioned lower in space than said location of the midpoint of said single domain by a distance greater than 1 millimeter.

17. The key entity of claim 10, with a plurality of no less than thirteen of said keyed entity attached in common fashion to typical shafts of typical musical keyboards to enable command of a corresponding full octave of musical tones, with every other keyed entity of said plurality in lateral succession reversed 180 degrees from the preceeding unreversed adjacent keyed entity, with said unreversed keyed entity positioned with said single domain of said particular end positioned to the front of said musical keyboard closest to an operator relative to said second domain, with each of said reversed keyed entity offset back to a depth sufficient to align said third domain of each of said reversed keyed entity beside a neighboring third domain of said unreversed key entity, said alignment of a tolerance sufficient to empower a finger of said operator to sequentially trigger a chromatic glissando across the common two-dimensional plane established through said third domain of each of said plurality of said keyed entity.

18. The key entity of claim 17, with said single domain of said particular end of said reversed keyed entity no more than one half the length of the corresponding single domain of said particular end of said unreversed keyed entity.

19. A two dimensional display medium subdivided into a plurality of interactive domains, together with sensing electronic interface means, said interface means configured in common fashion to recognize and respond to operator selection of said domains for the purpose of enabling the command of musical tones, a majority of said domains being contained within the confines of a minimum of two types of spatial entities termed front keyed entities and rear keyed entities, with a minimum of twelve of said two types of spatial entities alternating in lateral sequence, a majority of said front keyed entities each having a minimum of two domains of differing shape, said two domains of differing shape distinguished as anterior domains in close proximity to and greater in width than posterior domains, said anterior domains laterally aligned as contiguous domains allowing sequential glissandos by operator selection, said anterior domains of a size to allow individual selection by said operator, said posterior domains greater in length than in width, a majority of said rear keyed entities each also having a minimum of two distinct domains of differing shape, said two distinct domains of differing shape distinguished as anterior distinct domains in close proximity to and lesser in width than posterior distinct domains, said posterior distinct domains laterally aligned as contiguous domains allowing sequential glissandos by operator selection, said posterior distinct domains of a size to allow individual selection by said operator, said anterior distinct domains greater in length than in width, said anterior distinct domains of said rear keyed entities in approximate lateral alignment with said posterior domains of said front keyed entities, said alignment sufficient to empower said operator to trigger a chromatic glissando along the path of said lateral alignment, said anterior distinct domains and said posterior domains with sufficient separation between them such that said operator can individually select between them.

20. The invention of claim 19, with a plurality of said front keyed entities each configured with a transition region between said anterior domains and said posterior domains, said transition region of a width less than the width of said anterior domains and said transition region of a width greater than the width of said posterior domains, with a plurality of said rear keyed entities each configured with an intermediate transition region between said anterior distinct domains and said posterior distinct domains, said intermediate transition region of a width greater than the width of said anterior distinct domains and said intermediate transition region of a width less than the width of said posterior distinct domains.

* * * * *